US010094624B2

(12) United States Patent
Somhorst et al.

(10) Patent No.: US 10,094,624 B2
(45) Date of Patent: Oct. 9, 2018

(54) FIN FOR HEAT EXCHANGER

(71) Applicant: Hanon Systems, Daejeon (KR)

(72) Inventors: Leo Somhorst, Lower Camden (GB); Petr Fabian, Studenka (CZ); Stephen Joyce, Surrey (GB); Marek Bursik, Jicin (CZ); Tomas Sikora, Jablunkov (CZ)

(73) Assignee: HANON SYSTEMS, Daejeon (KR)

( * ) Notice: Subject to any disclaimer, the term of this patent is extended or adjusted under 35 U.S.C. 154(b) by 18 days.

(21) Appl. No.: 14/990,881

(22) Filed: Jan. 8, 2016

(65) Prior Publication Data

US 2017/0198983 A1 Jul. 13, 2017

(51) Int. Cl.
*F28F 1/10* (2006.01)

(52) U.S. Cl.
CPC ..... *F28F 1/10* (2013.01)

(58) Field of Classification Search
CPC ..... F28F 1/10; F28F 1/26; F28F 1/28; F28F 1/14; F28F 1/20; F28F 1/30; F28F 1/38; F28F 2215/08; B21D 53/022; B21D 53/025; B21D 53/04
See application file for complete search history.

(56) References Cited

U.S. PATENT DOCUMENTS 2,647,731 A * 8/1953 Ludlow ..... F28D 1/05391 165/152
3,983,932 A * 10/1976 Yamaguchi ..... F28F 1/10 165/140
5,107,922 A 4/1992 So
5,560,425 A * 10/1996 Sugawara ..... F28D 1/0316 165/148
6,032,503 A 3/2000 Grippe
7,147,047 B2 12/2006 Wolk
8,418,752 B2 * 4/2013 Otahal ..... B21D 53/02 165/109.1
2004/0173344 A1 * 9/2004 Averous ..... B01J 19/249 165/173
2009/0133860 A1 5/2009 Harada et al.
2013/0199760 A1 8/2013 Kadle et al.

FOREIGN PATENT DOCUMENTS

EP 0005959 A1 * 12/1979 ..... B21D 13/04
EP 2778592 A1 9/2014

* cited by examiner

*Primary Examiner* — Orlando E Aviles Bosques
*Assistant Examiner* — Jose O Class-Quinones
(74) *Attorney, Agent, or Firm* — Shumaker, Loop & Kendrick, LLP; James D. Miller

(57) ABSTRACT

A fin for a heat exchanger includes a member and a first row formed in the member. The first row having a plurality of valley sections alternating with a plurality of crest sections. A plurality of walls is interposed between and integrally joins the plurality of valley sections and the plurality of crest sections. At least one of the plurality of walls of the first row is angled with respect to a lateral axis of the member. A second row is formed in the member, the second row having a plurality of valley sections alternating with a plurality of crest sections and a plurality of walls interposed between and integrally joining the plurality of valley sections to the plurality of crest sections.

8 Claims, 8 Drawing Sheets

FIN FOR HEAT EXCHANGER

FIELD OF THE INVENTION

The invention relates to a heat exchanger, particularly to a lanced offset fin for a heat exchanger having angled walls.

BACKGROUND OF THE INVENTION

As is commonly known, heat exchangers are employed to transfer heat between a fluid flowing through the heat exchanger and air. Heat exchangers typically contain a heat exchange core having a plurality of tubes or plates interposed with a plurality of fins. Air flows through the fins of the heat exchange core. The fins facilitate heat transfer between the fluid of the heat exchanger and the air. In certain applications, the fins can additionally provide structural support to the heat exchange core.

Various types of fins are known in the art to improve the heat transfer efficiency of the fins. For example, certain types of fins include louvres on a planar portion of the fin to increase turbulence. Increased turbulence increases a heat transfer coefficient between the surface of the fin and the air flowing therethrough. An increase in the heat transfer coefficient increases the heat transfer efficiency of the fin. In another example, U.S. Pat. Appl. Pub. No. 2013/0199760 discloses split mini louvered fins to further improve heat transfer efficiency. However, louvered fins increase fin weight, density, and materials employed, which can be undesirable. Louvered fins and split mini louvered fins reduce the structural integrity of the heat exchange core which can be problematic, especially in scenarios where greater loads are applied to the heat exchange core. Additionally, the mini louvered fins typically do not extend an entire height of the planar portions of the fins due to design constraints which limits maximum efficiency of the fins. Furthermore, because the louvres protrude from the planar portions of the fins, a cross-sectional flow area between adjacent planar portions of the fins is compromised, which may inhibit air flow through the fins.

In another example, lanced offset fins are employed in some heat exchangers. Lanced offset fins may be employed in heat exchangers having limited package size constraints and/or to increase the structural integrity of the heater core. An example of heat exchangers that may be limited in package size and require the heat exchange core to have an increased structural rigidity are water-cooled charge air coolers (WCAC's). The heat exchangers with limited package sizes, such as the WCAC's, require a high heat transfer density per heat exchanger volume. In applications where a high heat transfer density per heat exchanger volume is required, it is continually desired to improve the heat transfer efficiency.

It would therefore be desirable to provide a fin for a heat exchanger that maximizes heat transfer efficiency and maintains the structural integrity of the heat exchanger while minimizing a weight of the heat exchanger, an amount of material utilized for the heat exchanger, and a cost of manufacturing the heat exchanger

SUMMARY OF THE INVENTION

In accordance and attuned with the present invention, a fin for a heat exchanger that maximizes heat transfer efficiency and maintains the structural integrity of the heat exchanger while minimizing a weight of the heat exchanger, an amount of material utilized for the heat exchanger, and a cost of manufacturing the heat exchanger has surprisingly been discovered.

According to an embodiment of the disclosure, a fin for a heat exchanger is disclosed. The fin includes a fin member. A first row formed in the member. The first row has a plurality of valley sections alternating with a plurality of crest sections. The plurality of walls are interposed between and join the plurality of valley sections of the first row and the plurality of crest sections of the first row. At least one of the plurality of walls of the first row is angled with respect to a lateral axis of the member. A second row is formed in the member. The second row has a plurality of valley sections alternating with a plurality of crest sections. A plurality of walls are interposed between and join the plurality of valley sections of the second row to the plurality of crest sections of the second row. The plurality of crest sections of the first row and the plurality of valley sections of the first row are offset from the plurality of crest sections of the second row and the plurality of valley sections of the second row.

According to another embodiment of the invention, a fin for a heat exchanger includes a member. The member includes a plurality of transverse rows. Each of the plurality of rows has a plurality of valley sections alternating with a plurality of crest sections. The plurality of valley sections and the plurality of crest sections of adjacent ones of the plurality of rows are offset from each other. A plurality of walls are interposed between and integrally joining the plurality of valley sections and the plurality of crest sections of each of the plurality of rows. One of the plurality of walls are angled with respect to a lateral axis extending in a direction of a width of the member.

According to yet another embodiment of the invention, a fin for a heat exchanger includes a member. The member includes a plurality of transverse rows. Each of the plurality of transverse rows has a plurality of valley sections alternating with a plurality of crest sections. The plurality of valley sections and the plurality of crest sections of adjacent ones of the plurality of transverse rows are laterally offset from each other. A plurality of walls are interposed between and integrally joining the plurality of valley sections and the plurality of crest sections of each of the plurality of rows. Each of the plurality of walls are angled with respect to a lateral axis extending along a width of the member.

BRIEF DESCRIPTION OF THE DRAWINGS

The above, as well as other objects and advantages of the invention, will become readily apparent to those skilled in the art from reading the following detailed description of an embodiment of the invention when considered in the light of the accompanying drawing which.

DETAILED DESCRIPTION OF THE INVENTION

The following detailed description and appended drawings describe and illustrate various embodiments of the invention. The description and drawings serve to enable one skilled in the art to make and use the invention, and are not intended to limit the scope of the invention in any manner.

FIGS. 1-8 illustrate various embodiments of lanced offset fins 10, 110, 210, 310. The fins 10, 110, 210, 310 are configured for use between plates or tubes in a heat exchange core of a heat exchanger (not shown) of a motor vehicle. The fins 10 facilitate a transfer of heat between air flowing therethrough and a fluid flowing through the plates or the tubes of the heat exchanger. The air flows through the fins 10, 110, 210, 310 in a direction indicated by the arrow. In a non-limiting example, the heat exchanger can be a water-cooled charge air cooler (WCAC) for use in a charge air circuit of the motor vehicle. However, it is understood the fins 10, 110, 210, 310 can be employed with any type of heat exchange core, as desired.

Figure 1:
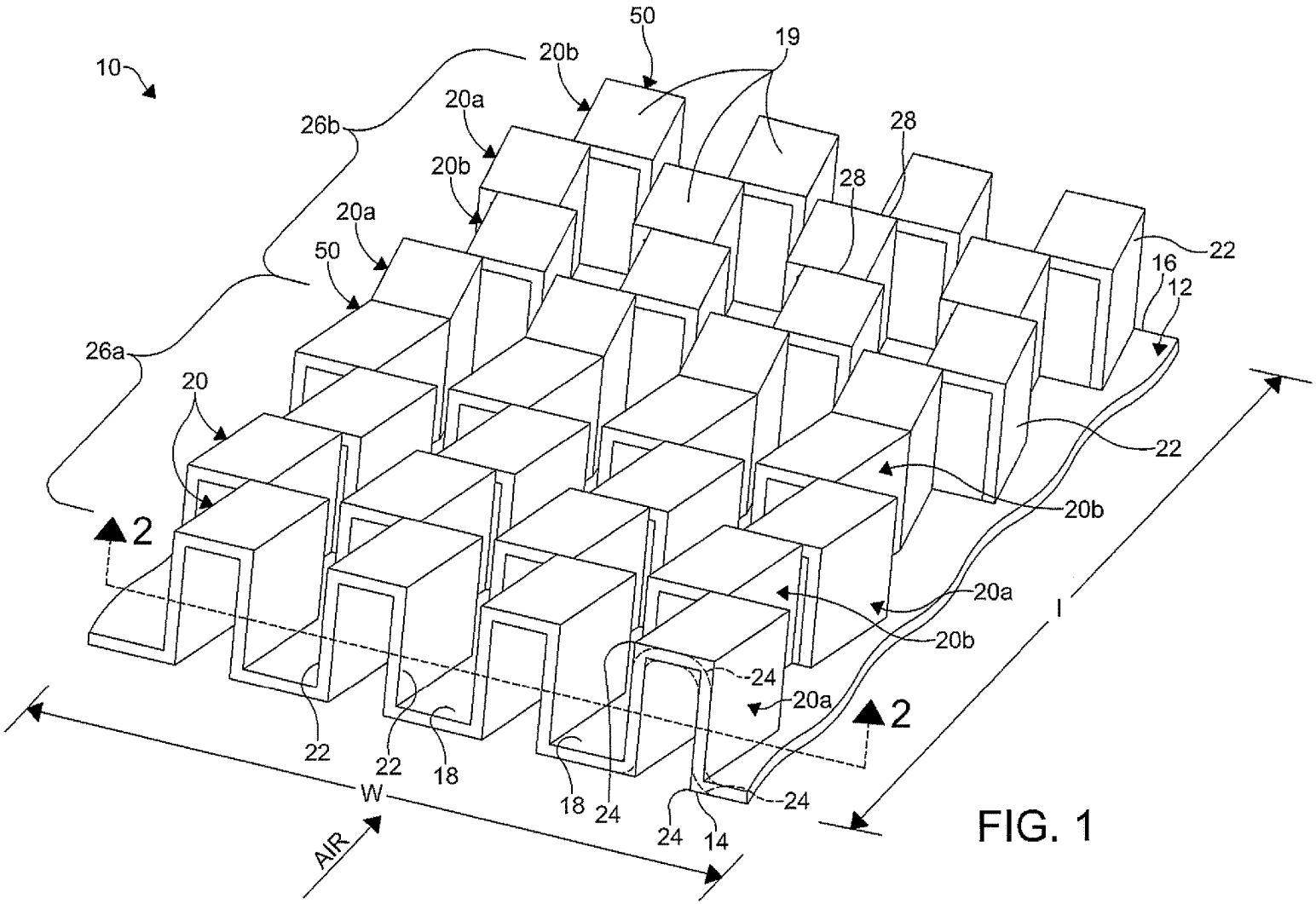
FIG. 1 is a fragmentary top perspective view of a fin of a heat exchanger according to an embodiment of the invention.
Figure 2:
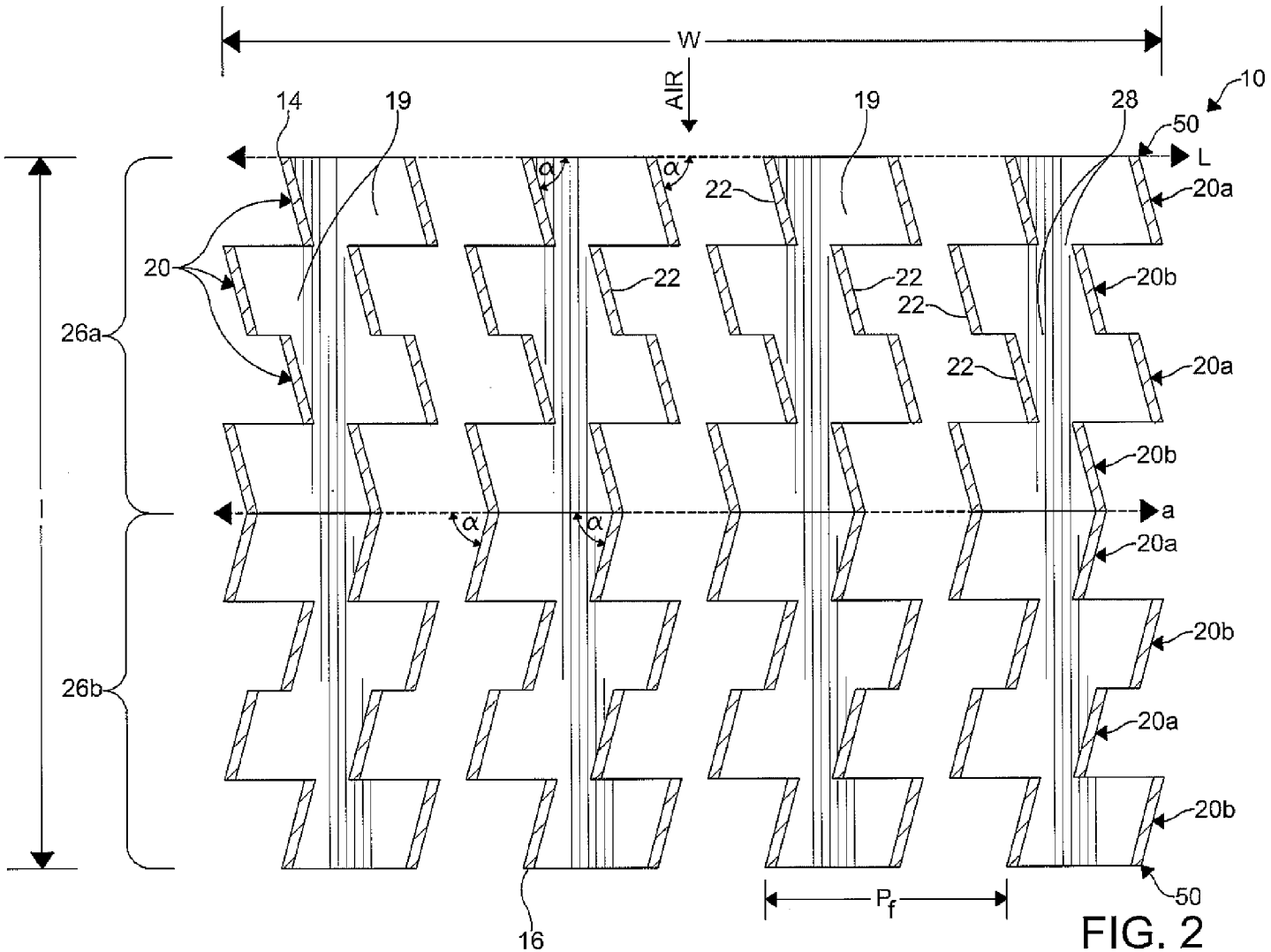
FIG. 2 is a cross-sectional view of the fin of FIG. 1 taken along the line 2-2.

As shown in FIGS. 1-2, the fin 10 includes a corrugated fin member 12 having a length 1, a width w, a leading edge 14, and a trailing edge 16. The member 12 includes a plurality of substantially parallel transverse rows, or strips, 20. In the exemplary embodiment illustrated, the fin 10 has eight rows 20. However, in other embodiments, the fin 10 can have any number of rows, as desired. For example, the fin 10 could have four rows, twenty rows, forty rows, or one hundred rows depending on the heat exchanger configuration. Each of the rows 20 has alternating valley sections 18 and crest sections 19. Each of the valley sections 18 and each of the crest sections 19 are substantially flat and are configured to engage a surface of the plates or the tubes of the heat exchanger. It is understood that the valley sections 18 and the crest sections 19 can have slightly arcuate sections to accommodate certain manufacturing processes, if desired. Additionally, while only four crest sections 19 of each of the rows 20 are shown, it is understood each row 20 can include more or fewer than four crest sections 19.

In each of the rows 20, walls 22 are interposed between and integrally connect the valley sections 18 and the crest sections 19. Each of the crest sections 19 and the walls 22 adjacent to each of the crest sections 19 cooperate with each other to form a substantially rectangular cross-sectional shape. Likewise, each of the valley sections 18 and the walls 22 adjacent to each of the valley sections 18 cooperate with each other to form a substantially rectangular cross-sectional shape. In the embodiment shown, substantially orthogonal corners 24 having a substantially sharp edge are formed by the walls 22, the valley sections 18, and the crest sections 19. However, the corners 24 joining the walls 22 to the valley sections 18 and the crest sections 19 may have a slight radius or curvature, as illustrated by dotted lines in FIG. 1. Corners having a radius facilitate or result from certain forming processes such as rolling processes, for example.

In the embodiment shown in FIGS. 1-2, the plurality of rows 20 can be divided into sets of the rows 26*a*, 26*b* of the rows 20. In the embodiment illustrated, two of the sets of the rows 26*a*, 26*b* (also referred to herein as a first set of the rows 26*a* and a second set of the rows 26*b*) are shown. Each of the sets of rows 26*a*, 26*b* includes four of the rows 20. However, it is understood the rows 20 do not have to be divided into the sets of the rows 26*a*, 26*b*, can be divided into more than two sets of the rows 26*a*, 26*b* such as three, four, ten, twenty, thirty, or any number of the sets of the rows 26*a*, 26*b*, as desired. Additionally, each of the sets of the rows 26*a*, 26*b* can include more or fewer than four of the rows 20.

Each of the sets of the rows 26*a*, 26*b* has an alternately staggered configuration 50 wherein the valley sections 18 and the crest sections 19 of alternating ones of the rows 20 are aligned with each other but offset from the valley sections 18 and the crest sections 19 of adjacent ones of the rows 20. In the alternately staggered configuration 50, each of the sets of the rows 26*a*, 26*b* includes first alternating rows 20*a* interposed between and interfacing with second alternating rows 20*b*. The valley sections 18 and the crest sections 19 of the first alternating rows 20*a* are laterally offset from the valley sections 18 and the crest sections 19 of the second alternating rows 20*b*. The first alternating rows 20*a* can be laterally offset from the second alternating rows 20*b* by any distance as desired. In a non-limiting example, the first alternating rows 20*a* can be laterally offset from the second alternating rows 20*b* by a distance equal to about 25% of a fin pitch $P_f$ of each of the rows 20. In another example, the first alternating rows 20*a* can be laterally offset from the second alternating rows 20*b* by a distance equal to about 50% of the fin pitch $P_f$ of each of the rows 20. In other examples, the offset distance can be equal to any percentage of the fin pitch $P_f$ such as 10%, 30%, 75% or other percentage, as desired. In certain embodiments, such as shown, the first alternating rows 20*a* adjoin the second alternating rows 20*b* so a portion of each of the crest sections 19 of each of the first alternating rows 20*a* is continuous with a portion of the crest section 19 of the second alternating rows 20*b* at an interface 28.

As shown, each of the walls 22 of each of the rows 20 is non-orthogonally angled with respect to a lateral axis L extending in a direction of the width w of the fin 10 and nonparallel to the direction of the flow of air through the fin 10. Also as shown, the lateral axis L extending across the fin 10 is substantially parallel with the leading edge 14 and the trailing edge 16 of the fin 10. However, it is understood that some of the walls 22 of the rows 22 may be orthogonal to the lateral axis L and the leading edge 14 and the trailing edge 16 may have other orientations as desired. Acute angles $\alpha$ are formed between each of the walls 22 and the lateral axis L. The acute angles $\alpha$ formed can be any angle as desired to maximize a turbulence of air flowing through the fin 10 and the cross-sectional flow area formed between the walls 22. For example, the acute angle $\alpha$ can be greater than 60 degrees. However, the acute angle $\alpha$ can be less than 60 degrees, if desired.

As best shown in FIG. 2, each of the walls 22 of each of the sets of the rows 26*a*, 26*b* slopes with respect to the lateral axis L and a longitudinal axis 1 extending in a direction of the length 1 of the fin 10 and perpendicular to the lateral axis L. In certain embodiments, as illustrated, the slope values of the walls 22 of the first set of the rows 26*a* have a slope value that is equal to but opposite the slope value of the walls 22 of the second set of the rows 26*b*. The sets of the rows 26*a*, 26*b* are arranged in a substantially reverse configuration, or mirror images of, each other with respect to an axis a in the direction of the width w of the fin 10 intermediate the sets of the rows 26*a*, 26*b*. In this arrangement, the ends of the walls 22 of the rows 20 where the sets of the rows 26*a*, 26*b* converge align at the axis a. Other configurations can be contemplated, if desired. For example, the sets of the rows 26*a*, 26*b* can be arranged in a non-substantially reverse configuration, wherein the ends of the walls 22 of the rows 20 where the sets of the rows 26*a*, 26*b* converge are offset from each other at the axis a. It is understood, in embodiments where the rows 20 are divided into more than the two sets of the rows 26*a*, 26*b*, the slope value of each of the walls 22 of each of the sets of the rows 26*a*, 26*b* may be equal to but opposite the slope values of the walls 22 of adjacent ones of the sets of the rows 26*a*, 26*b* to form a continuous series of alternating sets of the rows 26*a*, 26*b* with alternating patterns. It is also understood where the rows 20 are not divided into sets of rows, the slope value of each of the walls 22 of each of the rows 20 is equal to but opposite the slope value of each of the walls 22 of adjacent ones of the rows 20.

Figure 3:
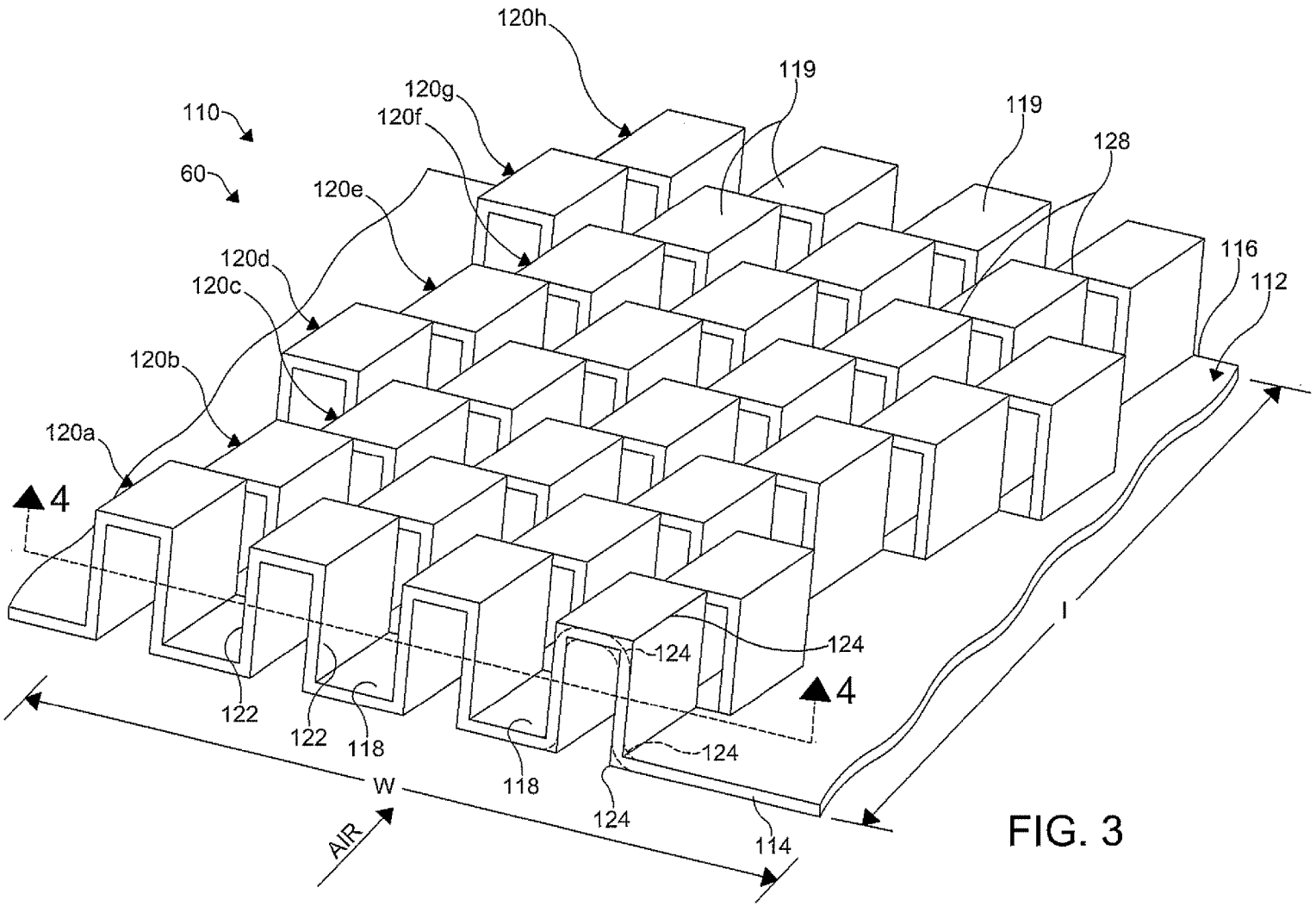
FIG. 3 is a fragmentary top perspective view of a fin of a heat exchanger according to another embodiment of the invention.
Figure 4:
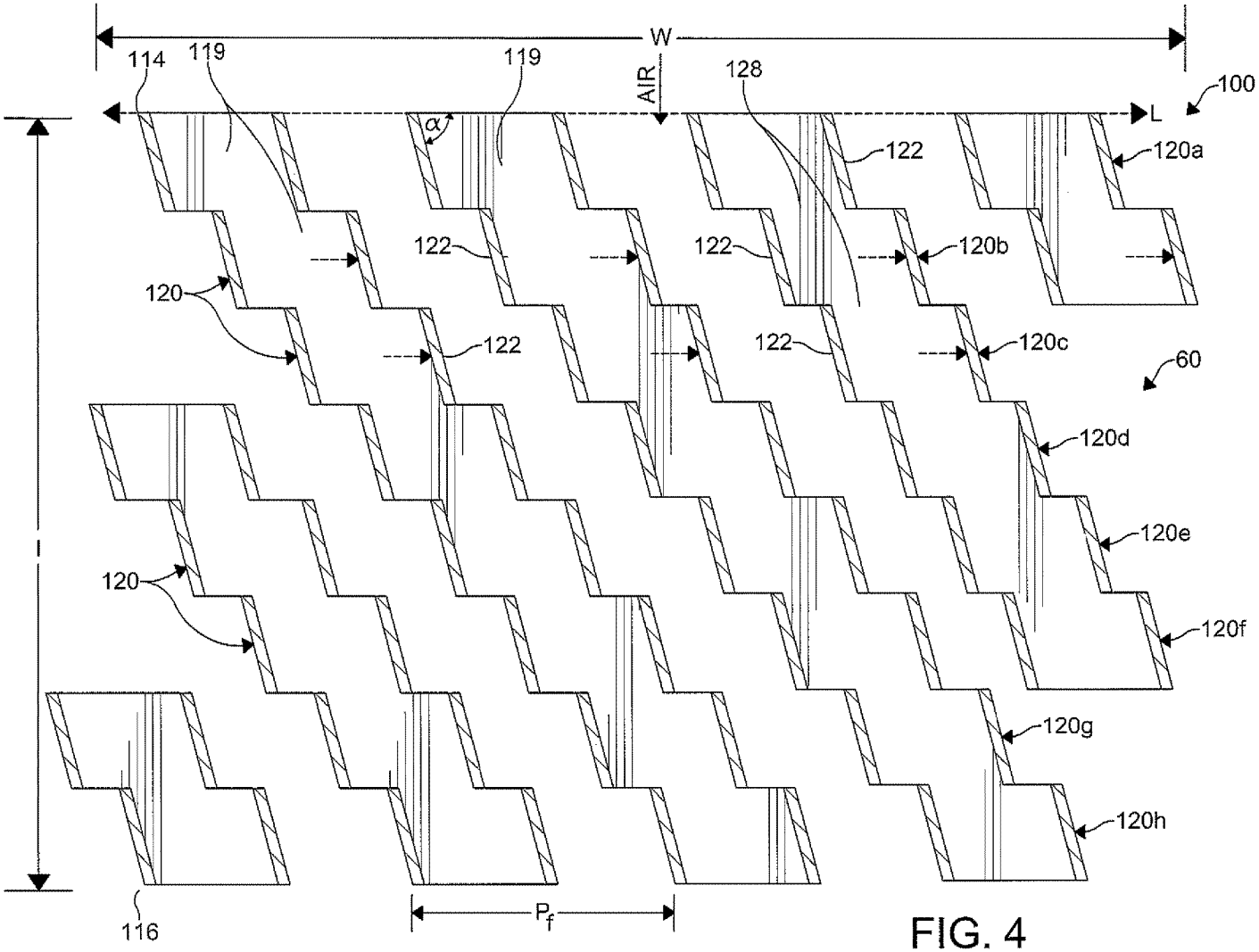
FIG. 4 is a cross-sectional view of the fin of FIG. 3 taken along the line 4-4.

FIGS. 3-4 illustrate a fin 110 according to another embodiment of the disclosure. Features similar to the fin 10 illustrated in FIGS. 1-2 are denoted with the same reference numeral with a leading number "1" before the reference numeral for clarity. The fin 110 is substantially similar to the fin 10 described hereinabove with reference to FIGS. 1-2, except the rows 120 are not divided into sets of the rows 120 and include a continuously staggered configuration 60 instead of the alternately staggered configuration 50.

In the continuously staggered configuration 60, the valley sections 118 and the crest sections 119 of each of the rows 120, in a direction from the leading edge 114 to the trailing edge 116, are successively offset from the valley sections 118 and the crest sections 119 of an adjacent preceding one of the rows 120 at an offset distance in an offset direction indicated by the dotted arrow. In the exemplary embodiment illustrated, the fin 110 has eight rows 120, consecutively numbered from the leading edge 114 to the trailing edge 116 as 120*a*, 120*b*, 120*c*, 120*d*, 120*e*, 120*f*, 120*g*, 120*h*. However, more or fewer than eight rows 120 can be contemplated, such as 10, 50, 100, or any other number configured to facilitate heat transfer efficiency, for example. The offset distance between the valley sections 118 and the crest sections 119 of each of the rows 120*b*, 120*c*, 120*d*, 120*e*, 120*f*, 120*g*, 120*h* and the valley sections 118 and the crest sections 119 of preceding adjacent ones of the rows 120*a*, 120*b*, 120*c*, 120*d*, 120*e*, 120*f*, 120*g*, is equal to a percentage of the fin pitch $P_f$ of each of the rows 120*a*, 120*b*, 120*c*, 120*d*, 120*e*, 120*f*, 120*g* such as 15%, 20%, 25%, 50% of the fin pitch $P_f$ or other percentage as desired. Each of the valley sections 118 and the crest sections 119 of each of the rows 120*b*, 120*c*, 120*d*, 120*e*, 120*f*, 120*g* is offset from the valley sections 118 and the crest sections 119 of each of the preceding rows 120*a*, 120*b*, 120*c*, 120*d*, 120*e*, 120*f* in the same offset direction. As shown in FIG. 4, in the continuously staggered configuration 60, the crest sections 119 form a diagonal pattern across the length of the fin 110.

Figure 5:
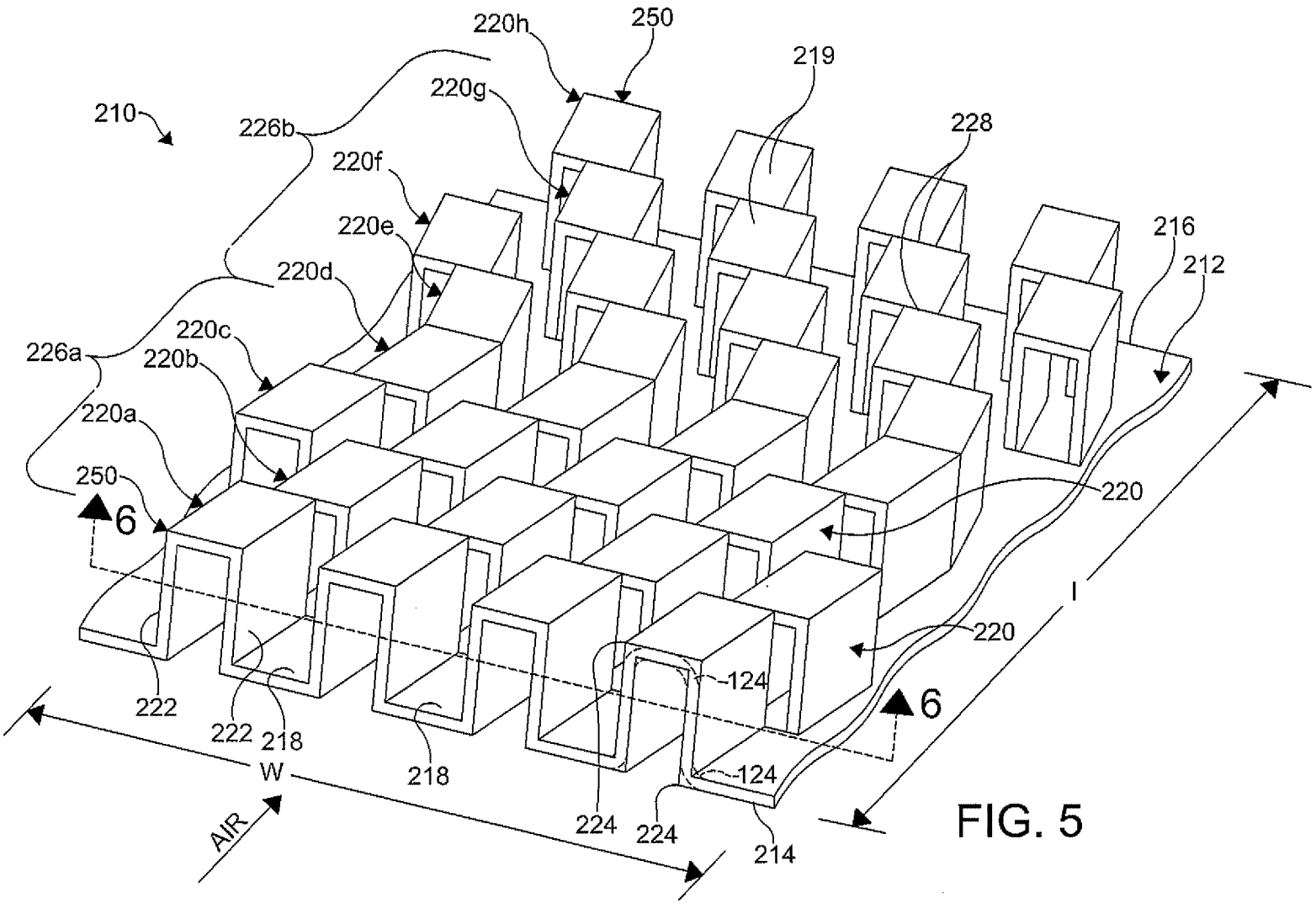
FIG. 5 is a fragmentary top perspective view of a fin of a heat exchanger according to another embodiment of the invention.
Figure 6:
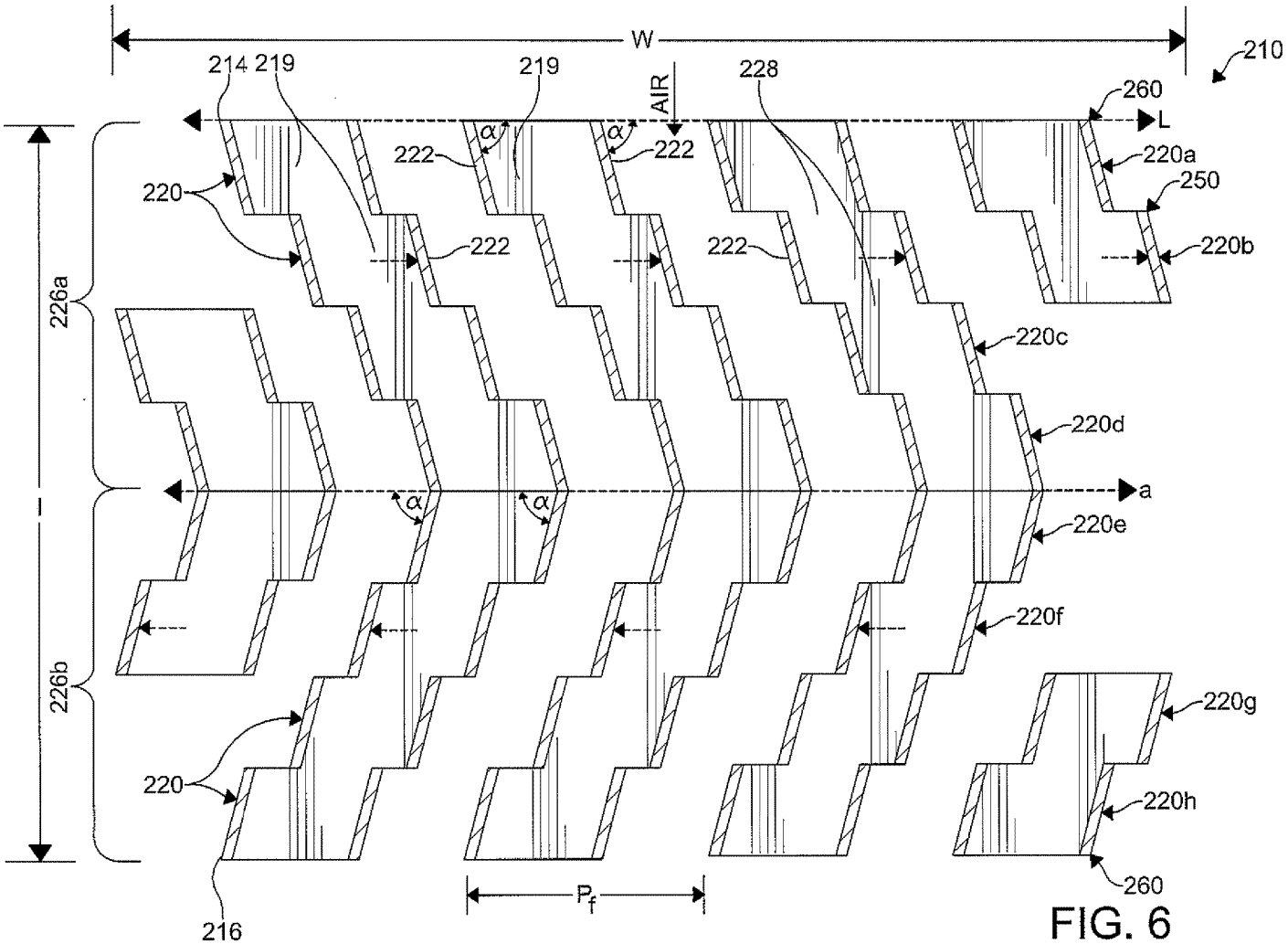
FIG. 6 is a cross-sectional view of the fin of FIG. 5 taken along the line 6-6.

FIGS. 5-6 illustrate a fin 210 according to another embodiment of the disclosure. Features similar to the fins 10, 110 illustrated in FIGS. 1-4 are denoted with the same reference numeral with a leading number "2" instead of the leading number "1" for clarity. The fin 210 is substantially similar to the fin 110 described hereinabove with reference to FIGS. 3-4, except the rows 220 are divided into sets of rows 226*a*, 226*b*. Each of the sets of the rows 226*a*, 226*b* includes the continuously staggered configuration 260. Additionally, the slope values of the walls 222 of the first set of the rows 226*a* have a slope value that is equal to but opposite the slope values of the walls 222 of the second set of the rows 226*b*.

The sets of the rows 226*a*, 226*b* are arranged in a substantially reverse configuration, or mirror image of, each other with respect to the axis a in the direction of the width w of the fin 210 intermediate the sets of the rows 226*a*, 226*b*. In this arrangement, the ends of the walls 222 of the rows 220 where the sets of the rows 226*a*, 226*b* converge align at the axis a. Other configurations can be contemplated, if desired. For example, the sets of the rows 226*a*, 226*b* can be arranged in a non-substantially reverse configuration, wherein the ends of the walls 222 of the rows 220 where the sets of the rows 226*a*, 226*b* converge are offset from each other at the axis a. In the embodiment illustrated, the fin 210 includes two sets of the rows 226*a*, 226*b* each including four rows 220. However, more than two sets of the rows 226*a*, 226 can be contemplated. Likewise, more or fewer than four rows 220 can be contemplated such as one, two, ten, twenty, or any other number, as desired. It is understood, in embodiments where the rows 220 are divided into more than the two 226*a*, 226*b*, the slope value of each of the walls 222 of each of the sets of the rows 226*a*, 226*b* may be equal to but opposite the slope values of the walls 222 of adjacent ones of the sets of the rows 226*a*, 226*b* to form a continuous series of alternating sets of the rows 226*a*, 226*b* with alternating patterns. It is also understood where the rows 220 are not divided into sets of rows, the slope value of each of the walls 222 of each of the rows 220 is equal to but opposite the slope value of each of the walls 222 of adjacent ones of the rows 220.

Figure 7:
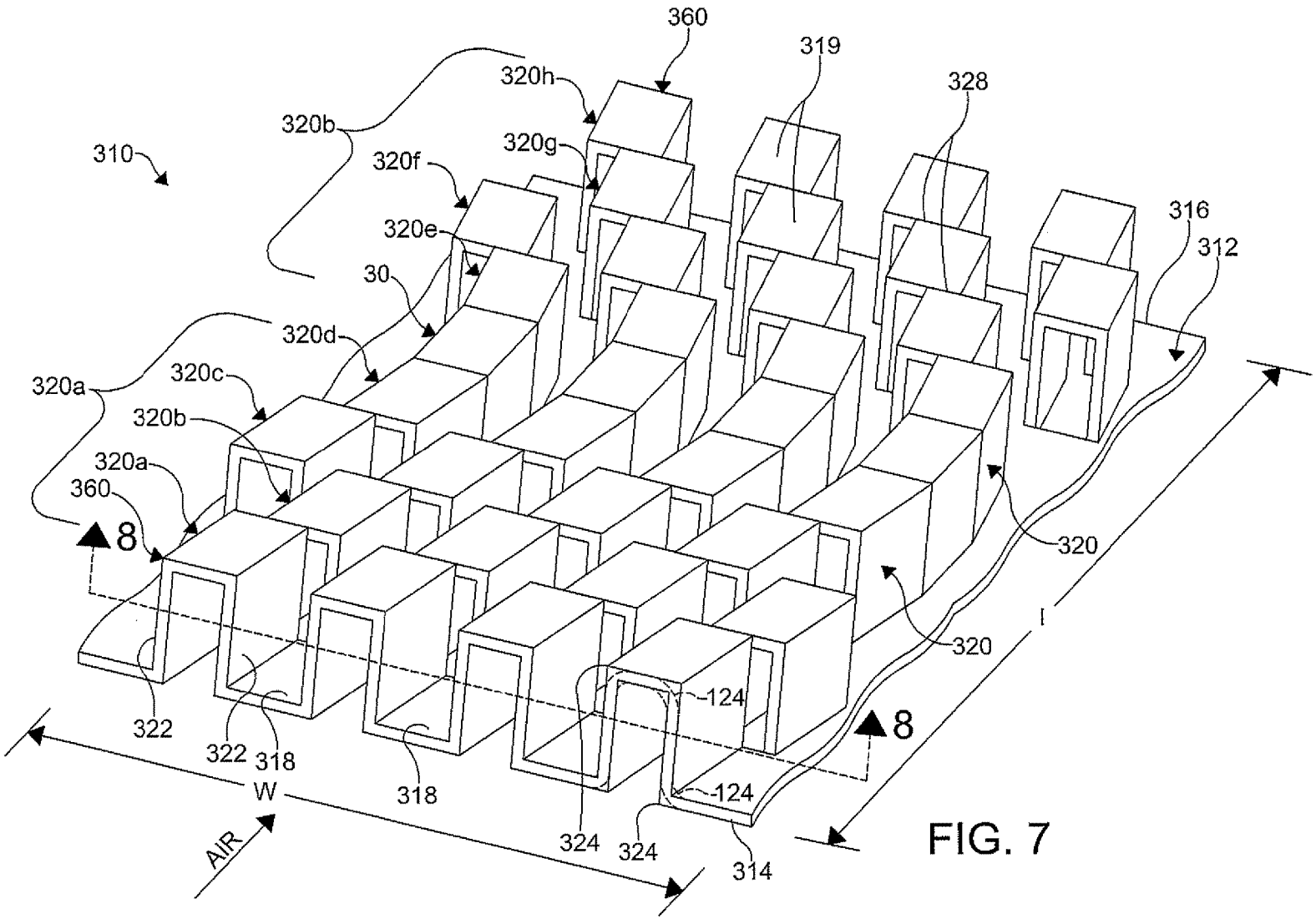
FIG. 7 is a fragmentary top perspective view of a fin of a heat exchanger according to another embodiment of the invention.
Figure 8:
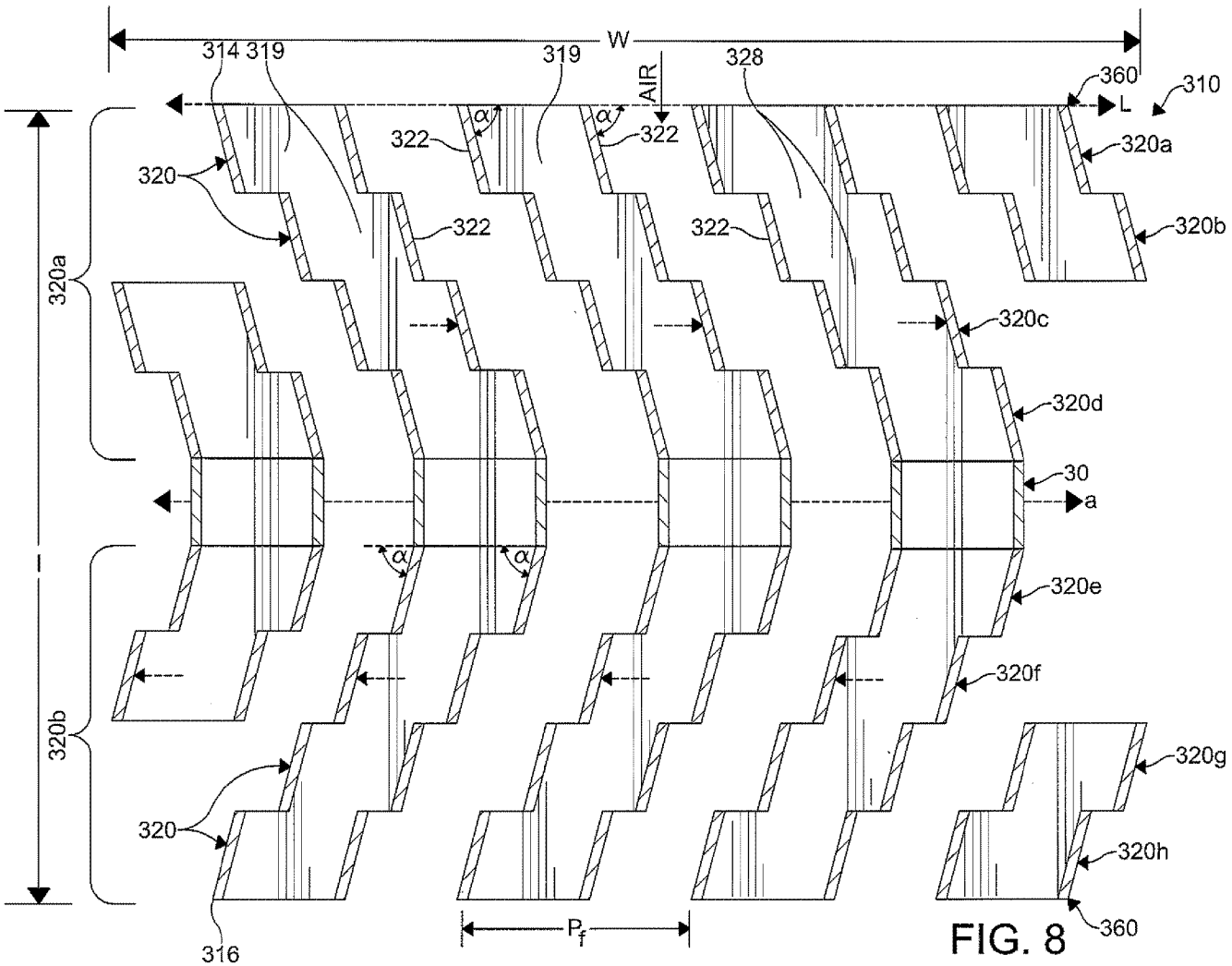
FIG. 8 is a cross-sectional view of the fin of FIG. 7 taken along the line 8-8.

FIGS. 7-8 illustrate a fin 310 according to another embodiment of the disclosure. Features similar to the fin 10, 110, 210 illustrated in FIGS. 1-6 are denoted with the same reference numeral with a leading number "3" instead of the leading number "1" and "2" for clarity. The fin 310 is substantially similar to the fin 210 described hereinabove with reference to FIGS. 5-6, except an intermediary row 30 is disposed intermediate sets of rows 326*a*, 326*b*. The intermediary row 30 is similar to the rows 320 except the walls 322 of the intermediary row 30 are substantially orthogonal with respect to the lateral axis L and substantially parallel to the direction of the flow of air through the fin 310. In certain forming methods, the intermediary row 30 facilitates feasibility of forming the fin 310. Additionally, the intermediary row 30 facilitates optimal transition of the air flowing from the first set of the rows 326*a* to the second set of the rows 326*b*. While only one intermediary row 30 is shown, it is understood the fin 310 can include any number of the intermediary rows 30 disposed between the sets of the rows 326*a*, 326*b*, as desired.

The fins 10, 110, 210, 310 illustrated in FIGS. 1-8 represent exemplary embodiments of the present disclosure. Other fin configurations having at least one row 20, 120, 220, 320 with one of the walls 22, 122, 222, 322 angled with respect to the lateral axis L can be contemplated, as desired, to maximize heat transfer efficient. For example, the angles and/or slope values of the walls 22, 122, 222, 322 can alternate or vary from each other through the rows 20, 120, 220, 320 or within each of the rows 20, 120, 220, 320. In another example, the rows 20, 120, 220, 320 can have alternating angled walls 22, 122, 222, 322 and orthogonal walls 22, 122, 222, 322 with respect to the lateral axis L. Additionally, a fin configuration can be similar to the fin 310 of FIGS. 7-8. However, a gap is formed intermediate the sets of the rows 26*a*, 26*b* instead of the intermediary row 330.

The fins 10, 110, 210, 310 can be formed by any process suitable for forming lanced offset fins, now known or later developed. For example, the fins 10, 110, 210, 310 can be formed by a roll forming process from elongated strips of sheet metal or by a punching process. Any material suitable for forming the fins 10, 110, 210, 310 and maximizing heat transfer efficiency can be employed.

To assemble, the fin 10, 110, 210, 310 is positioned in the heat exchange assembly of the heat exchanger. The valley sections 18, 118, 218, 318 and the crest sections 19, 119, 219, 319 are configured to abut the plates or tubes of the heat exchange assembly. In application, the air flows through the fin 10, 110, 210, 310 from the leading edge 14, 114, 214, 314 to the trailing edge 16, 116, 216. 316 thereof. The angled walls 22, 122, 222, 322 effectuate an increase turbulence of the air along the entire height of the fins 10, 110, 210, 310. Heat is transferred between the air flowing through the fin 10, 110, 210, 310 and the fluid flowing through the plates or tubes.

Advantageously, due to the substantially rectangular cross-sectional shape formed by the valley sections 18, 118, 218, 318, the crest sections 19, 119, 219, 319, and the walls 22, 122, 222, 322, the lanced-offset fin 10, 110, 210, 310 enhances the structural rigidity of the heat exchange assembly. Additionally, the fins 10, 110, 210, 310 are beneficial in applications utilizing a heat exchanger, such as a WCAC, with limited package size and maximum efficiency requirements wherein minimizing weight and material is a key factor. With angled walls 22, 122, 222, 322, a turbulence of the air flowing through the fin 10, 110, 210, 310 can be increased. Increases in the turbulence increase a heat transfer coefficient between the surface of the fins 10, 110, 210, 310 and the air flowing therethrough. An increase in the heat transfer coefficient increases the heat transfer efficiency of the fin 10, 110, 210, 310. Further advantages of the fins 10, 110, 210, 310 include an increased turbulence of the air across the entire height of the fin 10, 110, 210, 310. With the fins 10, 110, 210, 310 of the present disclosure, neither heat transfer efficiency, structural integrity, nor desired weight or cost of heat exchanger is compromised, which often results when utilizing fins of the prior art.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A fin for a heat exchanger comprising:

a fin member;

a first row formed in the fin member extending in a direction of width of the fin member, the first row having a plurality of valley sections alternating with a plurality of crest sections, a plurality of walls interposed between and joining the plurality of valley sections of the first row and the plurality of crest sections of the first row, each of the plurality of walls of the first row angled with respect to the direction of width of the fin member; and a second row formed in the fin member extending in the direction of width of the fin member, the second row having a plurality of valley sections alternating with a plurality of crest sections, a plurality of walls interposed between and joining the plurality of valley sections of the second row to the plurality of crest sections of the second row, wherein a flow of a fluid through the fin member flows in a direction perpendicular to the direction of width of the fin member, the plurality of crest sections of the first row and the plurality of valley sections of the first row are offset from the plurality of crest sections of the second row and the plurality of valley sections of the second row, wherein each of the plurality of walls of the first row and each of the plurality of walls of the second row include a leading edge facing towards the flow of the fluid through the fin member and a trailing edge facing away from the flow of the fluid through the fin member, wherein the leading edges of all of the walls forming the first row are offset laterally in the direction of width of the fin member from the leading edges of all of the walls forming the second row, wherein each of the plurality of walls of the first row and each of the plurality of walls of the second row are angled with respect to the direction of width of the fin member to cause the trailing edge of each of the plurality of walls to be offset with respect to the direction of width of the fin member from the leading edge of that same one of the plurality of walls, wherein a direction of offset with respect to the direction of width of the fin member between the valley sections and the crest sections of the first row and the valley sections and the crest sections of the second row is the same as a direction of offset between the leading edge and the trailing edge of each of the walls of each of the first row and the second row.

2. The fin of claim 1, wherein each of the plurality of crest sections of the first row, each of the plurality of valleys sections of the first row, and the plurality of walls of the first row interposed between the plurality of valley sections of the first row and the plurality of crest sections of the first row form a substantially rectangular cross-sectional shape.

3. The fin of claim 1, wherein each of the plurality of crest sections of the second row, each of the plurality of valleys sections of the second row, and the plurality of walls of the second row interposed between the plurality of valley sections of the second row and the plurality of crest sections of the second row form a substantially rectangular cross-sectional shape.

4. The fin of claim 1, wherein corners formed between the plurality of valley sections of the first row and the plurality of walls of the first row and corners formed between the plurality of crest sections of the first row and the plurality of walls of the first row have a radius, and wherein corners formed between the plurality of valley sections of the second row and the plurality of walls of the second row and corners formed between the plurality of crest sections of the second row and the plurality of walls of the second row have a radius.

5. A fin for a heat exchanger comprising:

a fin member including a plurality of rows, each of the plurality of rows extending in a direction of a width of the member and having a plurality of valley sections alternating with a plurality of crest sections, wherein a flow of a fluid through the fin member flows in a direction perpendicular to the direction of the width, wherein the plurality of valley sections and the plurality of crest sections of each of the plurality of rows are offset with respect to the direction of the width of the member from the plurality of valley sections and the plurality of crest sections of an adjacent row; and a plurality of walls interposed between and joining the plurality of valley sections and the plurality of crest sections of each of the plurality of rows, wherein each of the plurality of walls includes a leading edge facing towards the flow of a fluid through the fin member and a trailing edge facing away from the flow of the fluid through the fin member, wherein the leading edges of all of the plurality of walls forming each of the plurality of the rows are offset with respect to the direction of the width of the fin member from the leading edges of all of the plurality of walls of each of the adjacent rows, wherein each of the plurality of walls is angled with respect to the direction of the width of the member to cause the trailing edge of each respective one of the plurality of walls to be offset with respect to the direction of the width of the fin member from the leading edge of that same one of the plurality of walls, wherein when continuing in a direction of the flow of the fluid through the fin member a direction of offset with respect to the direction of the width between the valley sections and the crest sections of an upstream row and the valley sections and the crest sections of an adjacent downstream row is the same as a direction of offset with respect to the direction of the width between the leading edge and the trailing edge of each of the walls.

6. The fin of claim 5, wherein the plurality of rows has a continuously staggered configuration.

7. A fin for a heat exchanger comprising:

a fin member including a plurality of transverse rows, each of the plurality of transverse rows extending in a lateral direction of the fin member and having a plurality of valley sections alternating with a plurality of crest sections, wherein a flow of a fluid through the fin member flows in a direction perpendicular to the lateral direction of the fin member, wherein the plurality of valley sections and the plurality of crest sections of each of the plurality of transverse rows are offset from the plurality of valley sections and the plurality of crest sections of an adjacent one of the plurality of transverse rows with respect to the lateral direction of the fin member; and a plurality of walls interposed between and joining the plurality of valley sections of each of the plurality of transverse rows and the plurality of crest sections of each of the plurality of transverse rows, wherein each of the plurality of walls includes a leading edge facing towards the flow of the fluid through the fin member and a trailing edge facing away from the flow of the fluid through the fin member, wherein the leading edges of all of the plurality of walls forming each of the plurality of transverse rows are offset in the lateral direction of the fin member from the leading edges of all of the plurality of walls of each of the adjacent transverse rows, wherein each of the plurality of walls is angled with respect to the lateral direction of the fin member to cause the trailing edge of each respective one of the plurality of walls to be offset with respect to the lateral direction of the fin member from the leading edge of that same one of the plurality of walls, wherein when continuing in the direction of the flow of the fluid through the fin member a direction of offset with respect to the lateral direction between the valley sections and crest sections of an upstream one of the plurality of transverse rows and the valley sections and the crest sections of an adjacent downstream one of the plurality of transverse rows is the same as a direction of offset with respect to the lateral direction between the leading edge and the trailing edge of each of the plurality of walls.

8. The fin of claim 7, wherein the plurality of transverse rows has a continuously staggered configuration.

* * * * *